US006170183B1

(12) United States Patent
Keefe

(10) Patent No.: US 6,170,183 B1
(45) Date of Patent: Jan. 9, 2001

(54) CORRUGATED YARD SIGN

(75) Inventor: Kevin Keefe, Cincinnati, OH (US)

(73) Assignee: Patriot Signage Incorporated, Dayton, KY (US)

( * ) Notice: Under 35 U.S.C. 154(b), the term of this patent shall be extended for 0 days.

(21) Appl. No.: 09/238,363

(22) Filed: Jan. 27, 1999

(51) Int. Cl.[7] ..... G09F 15/00
(52) U.S. Cl. ..... 40/606; 40/607; 248/156
(58) Field of Search ..... 40/606, 607; 248/156

(56) References Cited

U.S. PATENT DOCUMENTS

| | | | | |
|---|---|---|---|---|
| D. 282,711 | | 2/1986 | Nelson . | |
| 343,365 | | 6/1886 | Daniels . | |
| 733,148 | | 7/1903 | Chandler . | |
| 839,501 | * | 12/1906 | Munro | 248/156 |
| 1,444,449 | | 2/1923 | Beck . | |
| 1,590,722 | | 6/1926 | Brakmeier . | |
| 1,769,430 | * | 7/1930 | Henke | 248/156 |
| 1,863,608 | | 6/1932 | Stewart . | |
| 2,639,524 | | 5/1953 | Irving . | |
| 2,857,695 | | 10/1958 | Goetting . | |
| 3,469,335 | * | 9/1969 | Leigh | 40/610 |
| 3,716,288 | | 2/1973 | Kannenberg . | |
| 3,889,409 | | 6/1975 | Thomas . | |
| 4,009,532 | | 3/1977 | Thomas . | |
| 4,100,698 | * | 7/1978 | Fries | 47/29 |
| 4,103,445 | | 8/1978 | Smith et al. . | |
| 4,173,086 | | 11/1979 | Hempfling . | |
| 4,318,521 | | 3/1982 | Martin et al. . | |
| 4,647,491 | * | 3/1987 | Ireland et al. | 428/137 |
| 4,658,527 | | 4/1987 | Pingel . | |
| 4,660,310 | | 4/1987 | Farmer . | |
| 4,894,937 | | 1/1990 | Davis . | |
| 5,042,183 | | 8/1991 | Kennedy . | |
| 5,103,582 | | 4/1992 | Farmer . | |
| 5,307,580 | | 5/1994 | Farmer . | |
| 5,566,483 | * | 10/1996 | Ogren | 40/606 |

* cited by examiner

*Primary Examiner*—Cassandra Davis
(74) *Attorney, Agent, or Firm*—Wood, Herron & Evans, LLP

(57) ABSTRACT

A yard sign is formed from a plastic corrugated board and supported in the ground by two separate L-shaped rods. The rods have a long leg section. The leg section of at least two rods are inserted through separate corrugations on either side of the sign and forced into the ground by pressing against the bent portion. The rods have a diameter which is adapted to snuggly fit within the channels applying slight pressure against the channel to support the sign above the ground merely by the compression fit between the rod and the corrugation.

6 Claims, 2 Drawing Sheets

CORRUGATED YARD SIGN

BACKGROUND OF THE INVENTION

Yard signs are used for a wide variety of different applications including political posters, yard sale signs, house for sale signs, and the like. These can take many different forms. A simple yard sign is a sheet of printed cardboard stapled to a wooden stake. Another popular yard sign is a printed plastic sheet in the form of a bag which could be supported by a number of different supports, the primary of which is a U-shaped wicket. The wicket had two wire legs connected by a cross-member. This both supports the sign and maintains the bag taunt so that the indicia can be easily read.

In use, these are very practical since the plastic bags take up much less space than the cardboard signs and the wire wickets take up less space than the wood stakes. The wickets are also easier to insert into the ground. However, the wickets themselves still take up a large amount of space. These wickets need to be as large as the sign in order to maintain it taunt and to keep it from blowing away.

Another type of yard sign is made from corrugated board and preferably corrugated plastic board. One such sign is disclosed in Kennedy U.S. Pat. No. 5,042,183. This includes a H-shaped wire frame which has arms which project up into the corrugated board. Similar signs are disclosed in Davis U.S. Pat. No. 4,894,937 and Farmer U.S. Pat. No. 5,307,580.

The problem with each of these signs is the intricacy of the support. Both the Kennedy and Davis references disclose H-shaped frames which are relatively expensive to manufacture requiring welds and the like. Also they must be manufactured so that the members that run up the corrugations are aligned properly so that they can be easily inserted into the corrugations. The support disclosed in the Farmer reference is not as complex and certainly would not take up as much space. Unfortunately due to its construction, it is suitable only for relatively small signs. Otherwise due to this construction, with the legs so close together, the sign can be easily blown down. This also requires an intermediate support member which holds the legs together beneath the sign. Further with this sign it still requires that the support be manufactured carefully so that the individual legs will properly align with the corrugations so that it can be easily inserted into the sign. Basically the embodiment disclosed in Farmer is useless for any type of large yard sign.

SUMMARY OF THE INVENTION

The present invention is premised on the realization that a yard sign can be fabricated wherein the supports are very simple to manufacture and take up relatively little space.

More particularly the present invention is premised on the realization that a yard sign formed from a corrugated board and supported by two separate L-shaped rods will remain upright even in higher winds and when disassembled takes up very little space.

These signs can be easily assembled and do not require any precise tolerances for the support members. Further the corrugated sign itself is supported upright on these two supports by the pressure or friction between the metal rods and the corrugation. Thus the present invention provides not only a reduced cost for such corrugated signs but further simplifies installation and reduces storage space requirements.

The objects and advantages of the present invention will be further appreciated in light of the following detailed description and drawings in which:

DETAILED DESCRIPTION

Figure 1:
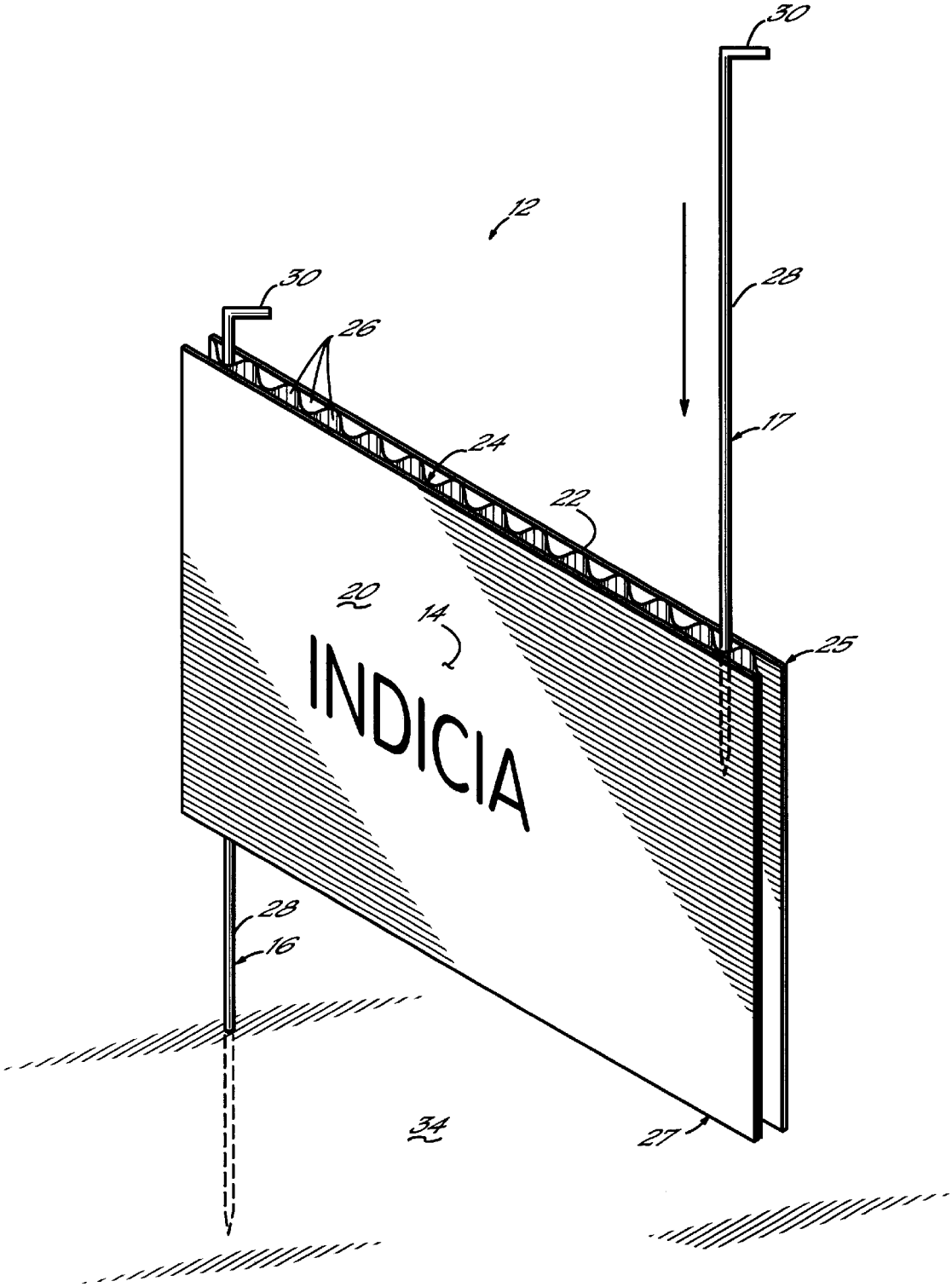
FIG. 1 is a perspective view of the present invention.

As shown in FIG. 1, the present invention is a yard sign 12 which includes a corrugated sign board 14 supported by first and second supports 16 and 17.

The sign board 14 has a front side face 20 with printed indicia as well as a rear sign face 22 generally with printed indicia (not shown). Between the front and rear faces is corrugation 24 which provides a plurality of channels 26 that run from the top edge 25 to the bottom edge 27 of the sign board 14.

First and second supports 16 and 17 are identical to each other and each include an elongated linear leg 28 which is adapted to run the entire length of the sign board and further to provide necessary clearance between the ground 34 and the bottom edge 27 of the sign board 14 and further provide sufficient portion of the leg inserted into the ground 34 to support the sign. The top of supports 16 and 17 is a small bent portion 30. This bent portion is bent at a 90° angle or greater and provides an upper surface to press the supports 16 and 17 into the ground without damaging a person's hand.

As shown more particularly in FIG. 1, the signs are very simply and easily installed. The metal rods 16 and 17 are simply inserted into selected channels 26 on either side of the sign board 14. These are pushed all the way through the channels 26 and extended until the bend 30 contacts the upper edge 25 of the sign board 14. These supports 16 and 17 are then pushed into the ground forcing a sufficient portion of the elongated linear leg 28 into the ground to support the sign. Generally 6 to 8 inches is sufficient. In this embodiment two supports are shown. However for larger signs three or four supports or more could be employed.

The diameter of the elongated linear leg portion 28 is slightly greater than the diameter of the channels 26 so that the leg will engage the walls of the corrugation 24 and the mere friction or pressure between the two will maintain the corrugated sign board 14 above the ground 34. For example, the corrugation may be 4 Mil corrugated board and the leg 28 will be about 9 gauge metal.

The corrugated yard sign 14 itself is preferably made from polypropylene plastic. This can be purchased from Coroplast Inc. Although less preferred, the sign can be formed from corrugated paperboard.

Figure 2:
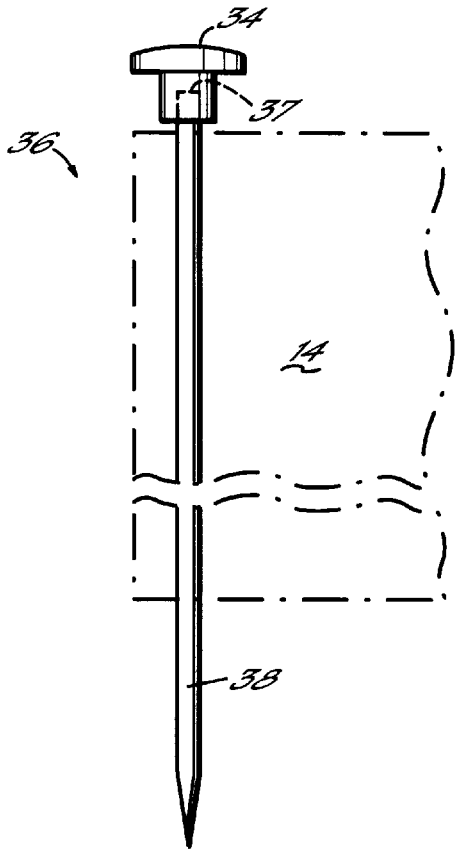
FIG. 2 is a perspective view partially broken away and partially in phantom of an alternate embodiment of a stake for use with the present invention.

FIG. 2 shows an alternate embodiment of the metal rods 16 and 17. In this embodiment, the support 36 includes a leg portion 38 which is merely a straight metal rod which has the diameter adapted to engage the corrugation 24 as with the diameter of leg 28. But instead of having the bend 30 of support 16 and 17, it utilizes a plastic cap 34 which simply rests on top 37 of the leg portion 38 enabling one to push it through the corrugation into the sign without cutting one's hands. One cap can be used repeatedly if desired.

Figure 3:
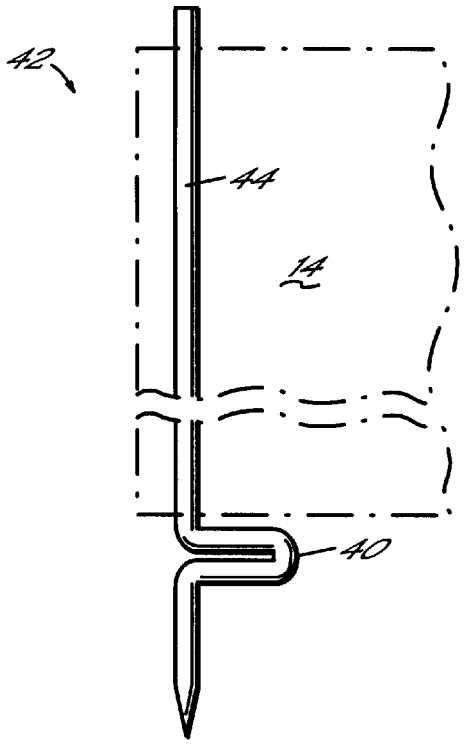
FIG. 3 is a perspective view partially broken away and partially in phantom of a second alternate embodiment of a stake for use in the present invention.

As shown in FIG. 3, a support 42 can include bend 40 formed in the lower portion of support 42 to facilitate insertion into the ground leaving the upper portion 44 straight. Support 42 is inserted in the ground by stepping on bend 40 with one's foot. In this embodiment, the metal rod would be inserted rough the bottom edge 27 of the sign 14 as opposed to the top edge 25 of the sign. However, this is somewhat less preferred as it takes up more space and requires more manufacturing to form the 180° adequate bend in the leg portion.

The present invention thus provides an effective support for a corrugated yard sign. It is very simple reducing manufacturing requirements and costs. Further because it utilizes a simple L-shaped support, it does not take up a large amount of storage space as would a metal wicket or an H-shaped frame. Further since the two supports are separate, they can be used to support basically any reasonable width of yard sign up to about two to three feet wide without requiring any extra connecting member or the like. Further additional supports can be used if necessary. Thus the present invention is not only inexpensive, it is simple to use and requires very little storage space and is significantly more versatile than prior signs. This has been a description of the present invention along with the preferred method of practicing the present invention. However, the invention itself should only be defined by the appended claims:

What is claimed is:

1. A yard sign supported in the ground comprising a corrugated planer board having a first and second sides and having indicia on at least one of said sides and corrugation between said sides holding said sides together;

wherein said corrugation defines a plurality of vertical channels extending from a top edge to a bottom edge of said board;

wherein said sign is supported by a plurality of separate rods each extended through one of said channels substantially through said entire board with a bottom portion of said rods inserted into the ground;

wherein said rods have a diameter effective to press against inside surfaces of said channels with sufficient frictional force to solely support said sign spaced above the ground;

said rods having an upper portion above said top edge of said sign configured to permit an individual to push the rods into the ground without hurting their hand.

2. The yard sign claimed in claim 1 wherein said upper portion of said rods comprise a bent portion enabling one to force said bottom portion of said rod into the ground.

3. The yard sign claimed in claim 1 wherein said rod has a diameter adapted to form a compression fit with said corrugation.

4. The yard sign claimed in claim 1 wherein said corrugated board is plastic.

5. The yard sign claimed in claim 1 comprising at least three separate said rods.

6. A yard sign supported in the ground comprising a corrugated planer board having a first and second sides and having indicia on at least one of said sides and corrugation between said sides holding said sides together;

wherein said corrugation defines a plurality of vertical channels extending from a top edge to a bottom edge of said board;

wherein said sign is supported by a plurality of rods each extended through one of said channels substantially through said entire board with a bottom portion of said rods inserted into the ground and an upper bent portion above said top edge configured to permit one to push said rods into said ground;

wherein said rods have a diameter effective to press inside surfaces of said channels with sufficient frictional force to solely support said sign spaced above said ground.

* * * * *